US010349809B2

(12) United States Patent
Dries et al.

(10) Patent No.: US 10,349,809 B2
(45) Date of Patent: Jul. 16, 2019

(54) PUMP ASSEMBLY FOR A DISHWASHING APPLIANCE

(71) Applicant: Haier US Appliance Solutions, Inc., Wilmington, DE (US)

(72) Inventors: John Edward Dries, Louisville, KY (US); Joel Charles Boyer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 10 days.

(21) Appl. No.: 15/671,193

(22) Filed: Aug. 8, 2017

(65) Prior Publication Data

US 2019/0046000 A1 Feb. 14, 2019

(51) Int. Cl.

| | |
|---|---|
| ***A47L 15/23*** | (2006.01) |
| ***A47L 15/42*** | (2006.01) |
| ***A47L 15/46*** | (2006.01) |
| ***F04D 13/02*** | (2006.01) |
| ***F04D 29/18*** | (2006.01) |
| ***F04D 29/54*** | (2006.01) |
| ***F04D 1/04*** | (2006.01) |
| ***F04D 15/00*** | (2006.01) |
| ***F04D 29/44*** | (2006.01) |
| ***F04D 29/58*** | (2006.01) |
| ***F04D 13/06*** | (2006.01) |

(52) U.S. Cl.

CPC ..... *A47L 15/4225* (2013.01); *A47L 15/23* (2013.01); *A47L 15/4221* (2013.01); *A47L 15/4293* (2013.01); *A47L 15/46* (2013.01); *F04D 1/04* (2013.01); *F04D 13/02* (2013.01); *F04D 13/0693* (2013.01); *F04D 15/0016* (2013.01); *F04D 29/181* (2013.01); *F04D 29/448* (2013.01); *F04D 29/548* (2013.01); *F04D 29/5806* (2013.01)

(58) Field of Classification Search

CPC .. A47L 15/23; A47L 15/4221; A47L 15/4225; A47L 15/4293; A47L 15/46; F04D 13/02; F04D 29/181; F04D 29/548

USPC ..... 134/56 D, 57 D, 58 D, 111, 155, 186

See application file for complete search history.

(56) References Cited

U.S. PATENT DOCUMENTS

| | | | |
|---|---|---|---|
| 386,345 | A | 7/1888 | Pickhardt |
| 3,425,355 | A | 2/1969 | La Flame et al. |
| 4,225,292 | A | 9/1980 | Hallerback et al. |
| 4,326,551 | A | 4/1982 | Voorhees |
| 5,273,061 | A | 12/1993 | Milocco |
| 5,924,432 | A | 7/1999 | Thies et al. |

(Continued)

FOREIGN PATENT DOCUMENTS

| | | | |
|---|---|---|---|
| CN | 1929247 | A | 3/2007 |
| CN | 104879319 | B | 1/2017 |

(Continued)

*Primary Examiner* — Levon J Shahinian

(74) *Attorney, Agent, or Firm* — Dority & Manning, P.A.

(57) ABSTRACT

A pump assembly for a dishwashing appliance includes an inner diffuser shell defining a motor housing and an outer diffuser shell spaced apart from the inner diffuser shell to define a diffusing plenum. A motor positioned within the motor housing rotates a wash pump impeller and urges a flow of wash fluid through the diffusing plenum. Within the diffusing plenum, guide vanes extend between the inner diffuser shell and the outer diffuser shell to diffuse and direct the flow of wash fluid.

20 Claims, 10 Drawing Sheets

(56) References Cited

U.S. PATENT DOCUMENTS

| | | | | |
|---|---|---|---|---|
| 5,947,680 | A | 9/1999 | Harada et al. | |
| 9,217,435 | B2 | 12/2015 | Moore et al. | |
| 2007/0166178 | A1 | 7/2007 | Moreland | |
| 2014/0112808 | A1* | 4/2014 | Moore | F04D 3/00 417/423.7 |

FOREIGN PATENT DOCUMENTS

| | | | |
|---|---|---|---|
| EP | 1126180 | B1 | 3/2005 |
| GB | 1406155 | | 9/1975 |

* cited by examiner

PUMP ASSEMBLY FOR A DISHWASHING APPLIANCE

FIELD OF THE INVENTION

The present disclosure relates generally to dishwasher appliances, and more particularly to improved pump assemblies for dishwasher appliances.

BACKGROUND OF THE INVENTION

Dishwasher appliances generally include a tub that defines a wash chamber. Wash fluid (e.g., various combinations of water and detergent along with optional additives) may be introduced into the tub where it collects in a sump space at the bottom of the wash chamber. Rack assemblies can be mounted within the wash chamber for receipt of articles for washing and multiple spray assemblies may be configured for directing the wash fluid towards articles disposed within the rack assemblies in order to clean such articles. During wash and rinse cycles, a circulation pump may be used to pump the wash fluid to the multiple spray assemblies and a device referred to as a diverter may be used to control the flow of wash fluid received from the pump.

Conventional circulation pumps are motor driven and positioned outside of the wash chamber in a horizontal orientation. Notably, this positioning requires that one or more seals be used to connect the pump inlet and outlet to the wash chamber, thereby increasing the likelihood of leaks. Certain circulation pumps are positioned within the sump, but may require complex constructions to ensure safe operation of the electric motor in the wet environment. In either construction, diverters are typically separate devices that are bulky, require additional and complicated plumbing systems, and use a dedicated, external motor or positioning mechanism to drive a diverter valve.

Accordingly, a dishwasher appliance that utilizes an improved fluid distribution system or pump assembly would be useful. More specifically, a pump assembly that is compact and distributes wash fluid throughout the wash chamber in a safe and efficient manner would be particularly beneficial.

BRIEF DESCRIPTION OF THE INVENTION

The present subject matter provides a pump assembly for a dishwashing appliance that includes an inner diffuser shell defining a motor housing and an outer diffuser shell spaced apart from the inner diffuser shell to define a diffusing plenum. A motor positioned within the motor housing rotates a wash pump impeller and urges a flow of wash fluid through the diffusing plenum. Within the diffusing plenum, guide vanes extend between the inner diffuser shell and the outer diffuser shell to diffuse and direct the flow of wash fluid. Additional aspects and advantages of the invention will be set forth in part in the following description, may be apparent from the description, or may be learned through practice of the invention.

In accordance with one exemplary embodiment of the present disclosure, a pump assembly for a dishwashing appliance is provided. The pump assembly defines an axial direction, a radial direction, and a circumferential direction. The pump assembly includes an inner diffuser shell defining a motor housing and an outer diffuser shell spaced apart from the inner diffuser shell to define a diffusing plenum. A plurality of guide vanes extends between the inner diffuser shell and the outer diffuser shell within the diffusing plenum.

A motor is positioned within the motor housing and includes a drive shaft for rotating a wash pump impeller and urging a flow of wash fluid through the diffusing plenum.

In accordance with another exemplary embodiment of the present disclosure, a dishwasher appliance is provided defining a vertical direction. The dishwasher appliance includes a wash tub that defines a wash chamber and a sump for collecting wash fluid. A pump assembly is positioned within the sump, the pump assembly defining an axial direction, a radial direction, and a circumferential direction. The pump assembly includes an inner diffuser shell defining a motor housing and an outer diffuser shell spaced apart from the inner diffuser shell to define a diffusing plenum. A plurality of guide vanes extends between the inner diffuser shell and the outer diffuser shell within the diffusing plenum. A motor is positioned within the motor housing and includes a drive shaft for rotating a wash pump impeller and urging a flow of wash fluid through the diffusing plenum.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
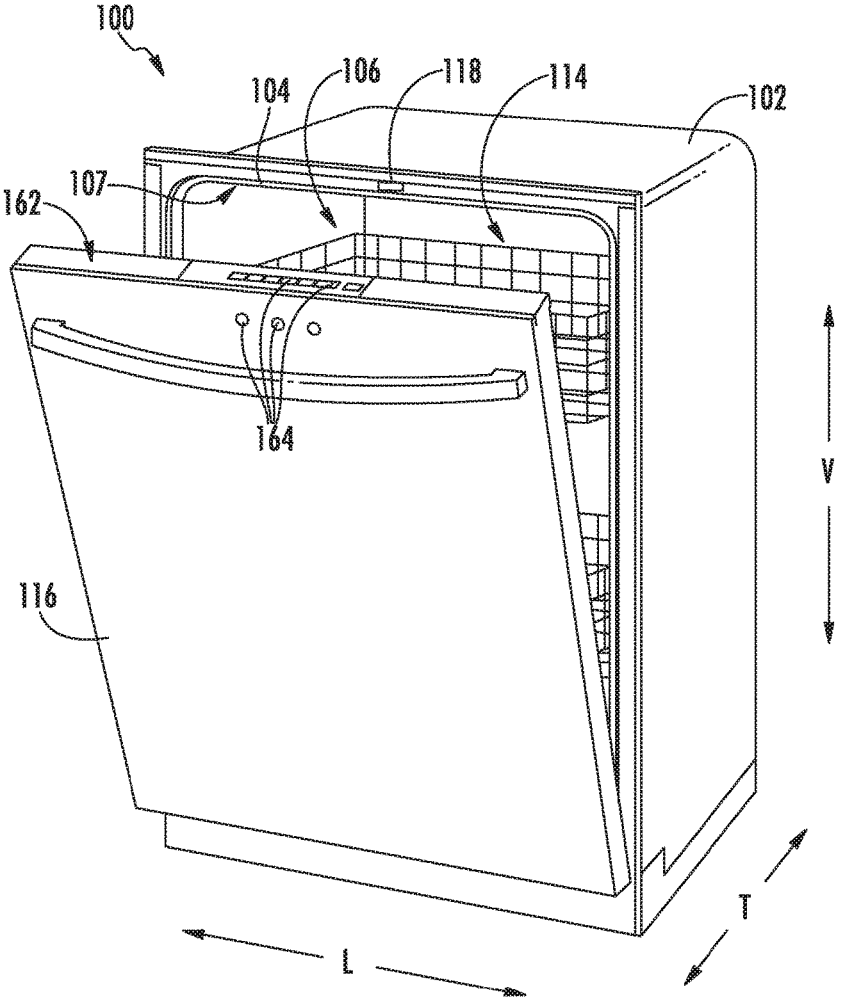
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
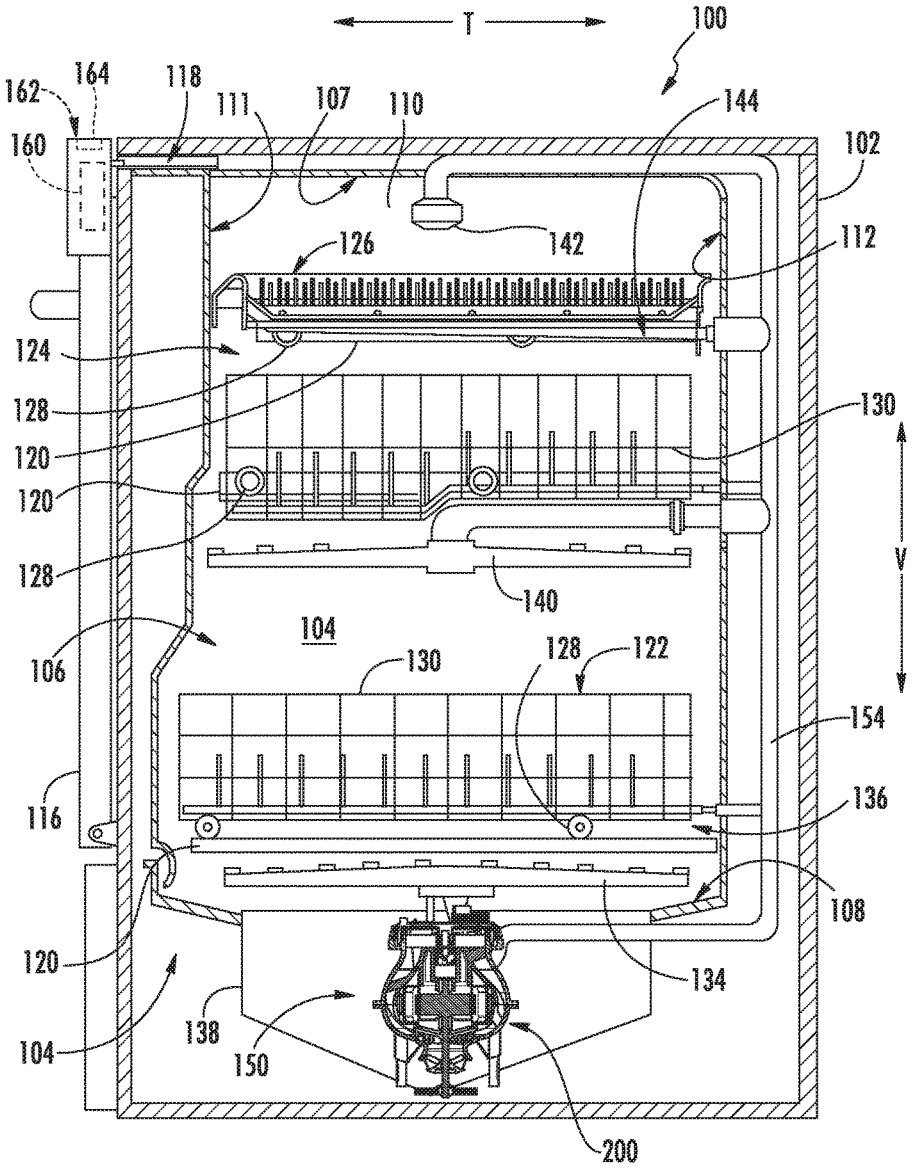
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

Each spray arm assembly 134, 140, 142, integral spray manifold 144, or other spray device may include an arrangement of discharge ports or orifices for directing wash fluid onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

The various spray assemblies and manifolds described herein may be part of a fluid distribution system or fluid circulation assembly 150 for circulating water and wash fluid in the tub 104. More specifically, fluid circulation assembly 150 includes a pump assembly 200 for circulating water and wash fluid (e.g., detergent, water, and/or rinse aid) in the tub 104, as will be described in detail below. Fluid circulation assembly 150 may include one or more fluid conduits or circulation piping for directing water and/or wash fluid from pump assembly 200 to the various spray assemblies and manifolds. For example, as illustrated in FIG. 2, a primary supply conduit 154 may extend from pump assembly 200, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Referring now generally to FIGS. 3 through 10, a pump assembly 200 will be described according to an exemplary embodiment of the present subject matter. According to the illustrated embodiment, pump assembly 200 is positioned within sump 138 of dishwasher appliance 100 for providing a flow of wash fluid as part of fluid circulation assembly 150. However, it should be appreciated that aspects of the present subject matter may be used to circulate fluid in any suitable appliance.

Figure 3:
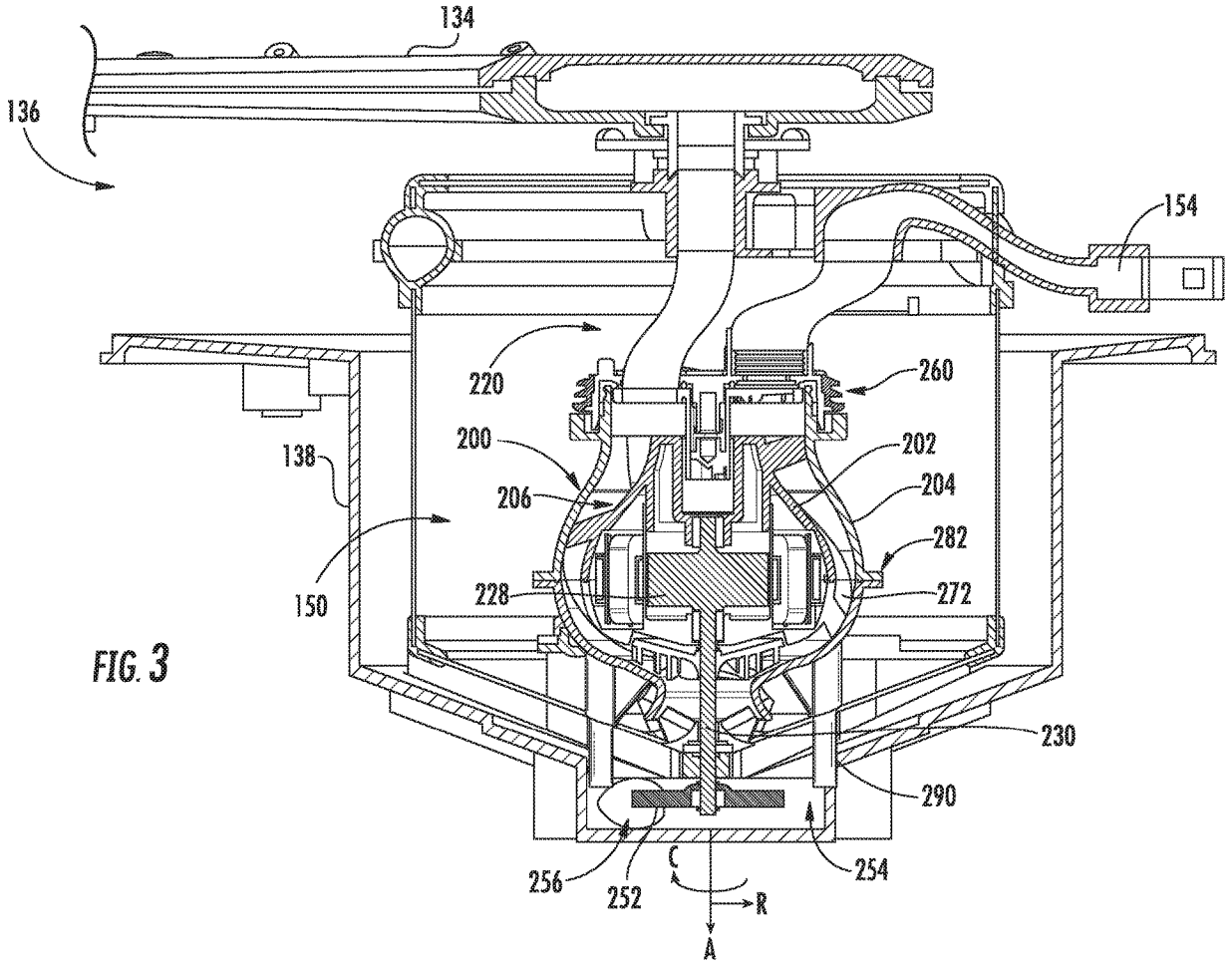
FIG. 3 provides a cross sectional view of a pump assembly positioned within a sump of the exemplary dishwashing appliance of FIG. 1 according to an exemplary embodiment of the present subject matter.
Figure 4:
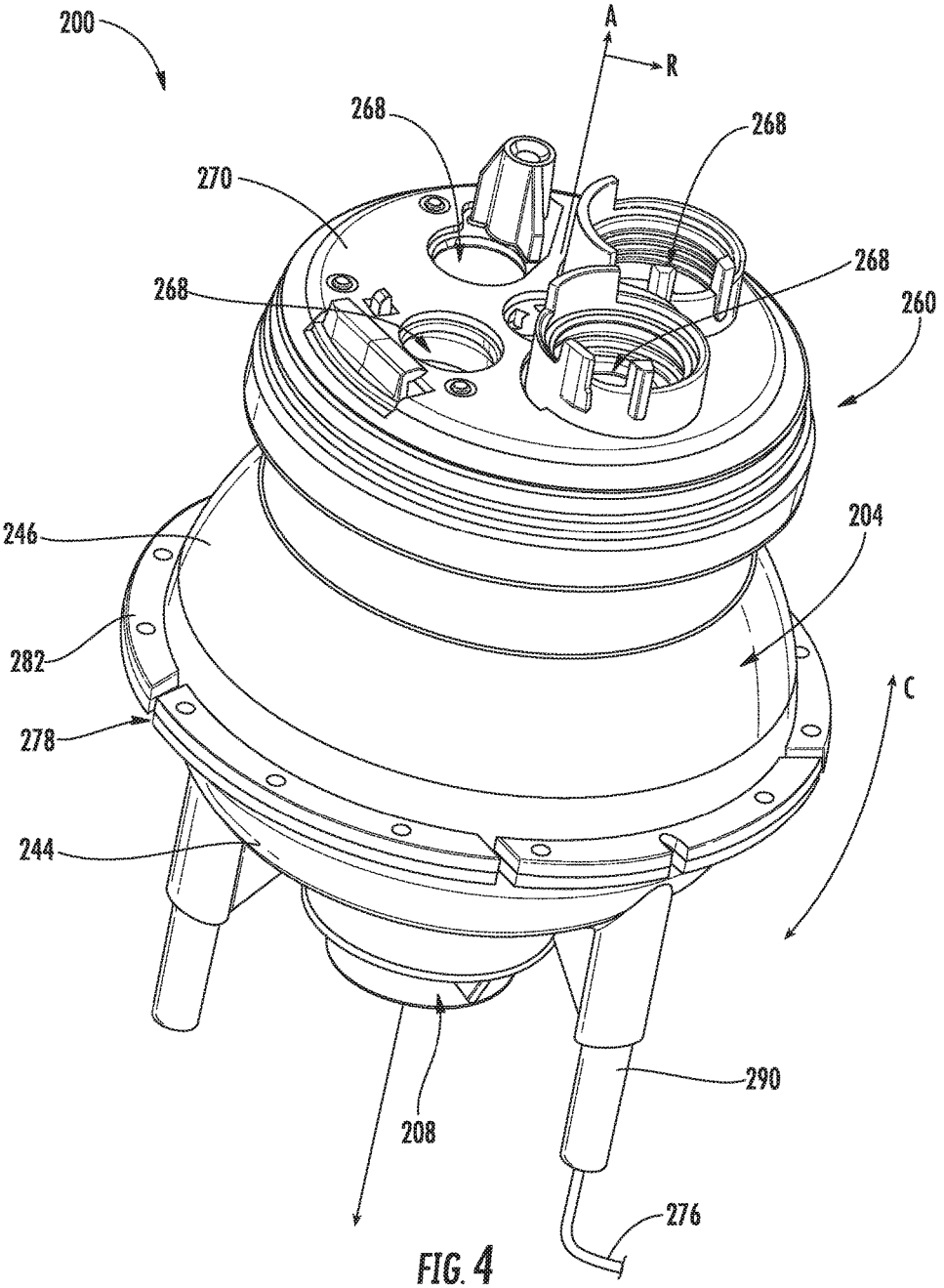
FIG. 4 provides a perspective view of the exemplary pump assembly of FIG. 3 according to an example embodiment of the present subject matter.
Figure 5:
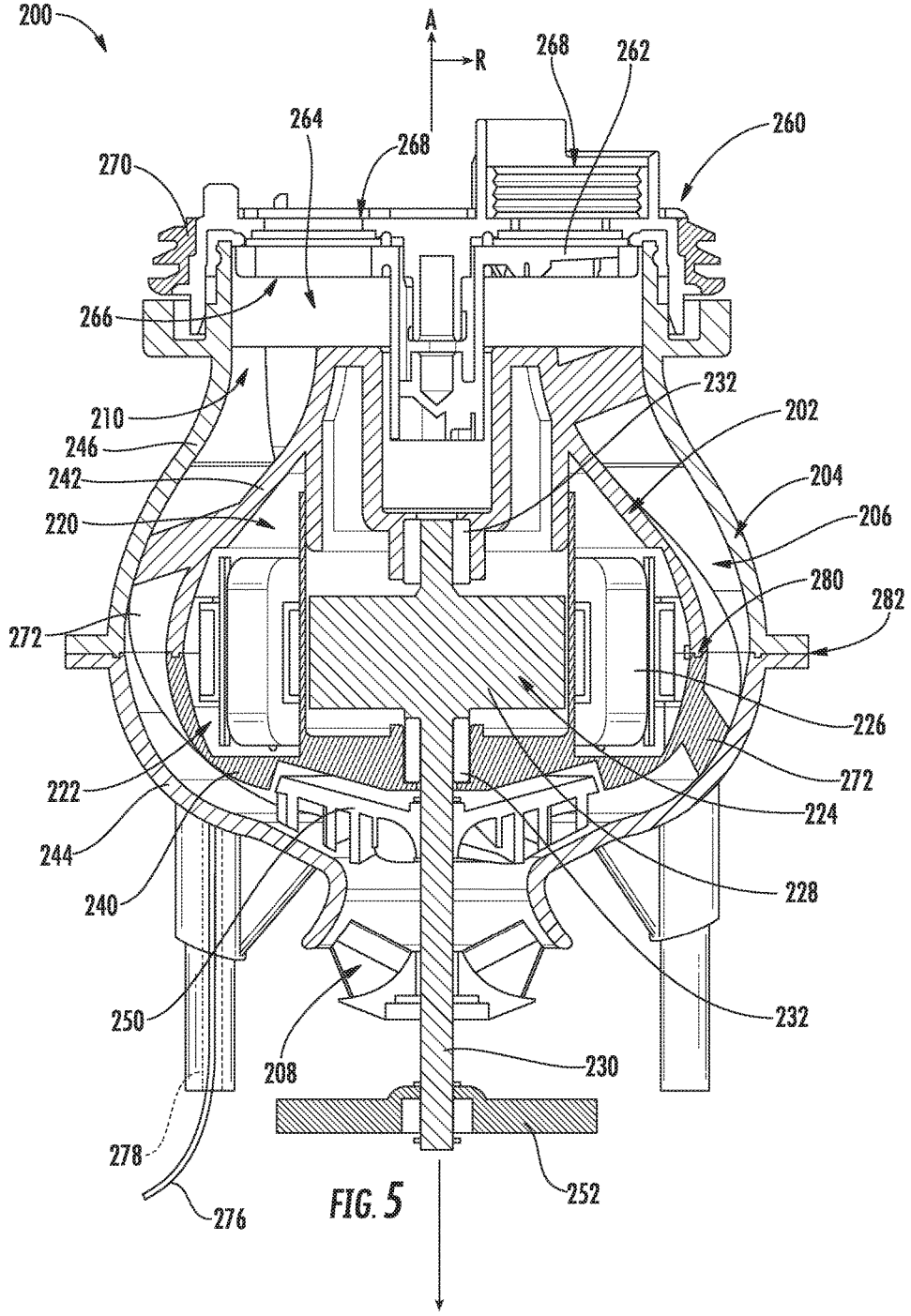
FIG. 5 provides a cross sectional view of the exemplary pump assembly of FIG. 3.

Referring now to FIGS. 3 through 5, pump assembly 200 generally defines an axial direction A, a radial direction R, and a circumferential direction C. According to the illustrated embodiment, pump assembly 200 is positioned entirely within sump 138 and is vertically oriented, e.g., such that the axial direction A is substantially parallel to the vertical direction V of dishwasher appliance 100. However, it should be appreciated that according to alternative embodiments, other coordinate systems may be used to describe pump assembly 200 which may be placed in different orientations and/or at different locations within dishwasher appliance 100.

As illustrated, pump assembly 200 includes an inner diffuser shell 202 and an outer diffuser shell 204 spaced apart from inner diffuser shell 202 to define a diffusing plenum 206. More specifically, for example, inner diffuser shell 202 and outer diffuser shell 204 generally extend along the axial direction A and inner diffuser shell 202 is positioned inward from outer diffuser shell 204 along the radial direction R. An inlet 208 is defined at one end of diffusing plenum 206 and an outlet 210 is defined at the opposite end of diffusing plenum 206 along the axial direction A. As illustrated, pump assembly 200 is vertically oriented with inlet 208 facing down toward the bottom of sump 138 along the vertical direction and outlet 210 being positioned toward a top of pump assembly 200 along the vertical direction V.

Referring still to FIGS. 3 and 5, pump assembly 200 includes a motor assembly 220 that is positioned within inner diffuser shell 202. In this regard, for example, inner diffuser shell 202 generally defines a motor housing 222 that is positioned inward from diffusing plenum 206 along the radial direction R. Motor housing 222 is generally configured for receiving all or part of a motor assembly 220. According to the illustrated embodiment, inner diffuser shell 202 wraps tightly around motor assembly 220 in a compact manner both to reduce the overall footprint of pump assembly 200 within the limited space of sump 138 and to increase the thermal communication between wash fluid in diffusing plenum 206 and motor assembly 220.

Figure 10:
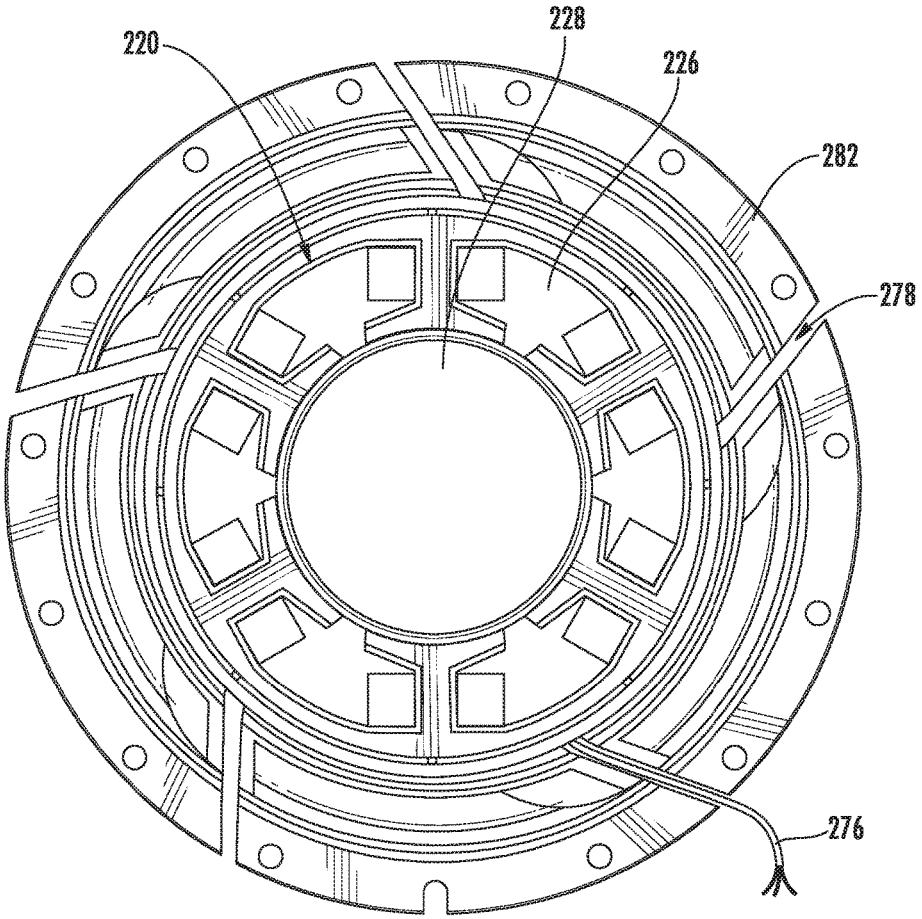
FIG. 10 provides a top view of a motor assembly positioned within the inner diffuser shell of the exemplary pump assembly of FIG. 3, with a top portion of the inner diffuser shell removed for clarity.

Motor assembly 220 generally includes a motor 224 positioned within motor housing 222. More specifically, as best shown in FIGS. 5 and 10, motor 224 is a brushless DC motor having a stator 226, a rotor 228, and a drive shaft 230 attached to rotor 228. As illustrated, motor assembly 220 further includes a plurality of motor bearings 232 also positioned within motor housing 222 for supporting the rotation of drive shaft 230.

During operation, a controller (e.g., a dedicated motor controller or an appliance controller such as controller 160) may control the speed of motor 224 and the rotation of drive shaft 230 by selectively applying electric current to stator 226 to cause rotor 228 and drive shaft 230 to rotate. Although drive motor 224 is illustrated herein as a brushless DC motor, it should be appreciated that any suitable motor may be used while remaining within the scope of the present subject matter. For example, according to alternative embodiments, motor 224 may instead be a stepper motor, a synchronous permanent magnet motor, an AC motor, or any other suitable type of motor in any suitable configuration.

As best illustrated in FIGS. 4 and 5, both inner diffuser shell 202 and outer diffuser shell 204 are two-piece assemblies. More specifically, inner diffuser shell 202 includes a lower inner portion 240 and an upper inner portion 242. Similarly, outer diffuser shell 204 includes a lower outer portion 244 and an upper outer portion 246. Such a construction may, for example, facilitate the easy installation and assembly of motor assembly 220 within motor housing 222. However, it should be appreciated that according to alternative embodiments, some of all of inner diffuser shell 202 and outer diffuser shell 204 may be formed as single integral piece. For example, according to another exemplary embodiment, inner diffuser shell 202 and outer diffuser shell 204 may be integrally formed as a single integral piece, e.g., via injection molding, and motor assembly 220 may be sized such that it may slide into motor housing 222. Other configurations and constructions are possible and within the scope of the present subject matter.

Referring generally to FIGS. 5 through 8, pump assembly 200 may further include a wash pump impeller 250 that is operably coupled to drive shaft 230. In this manner, motor 224 is configured for rotating wash pump impeller 250 to urge a flow of wash fluid through diffusing plenum 206. In addition, pump assembly 200 can include a drain pump impeller 252 that is also mounted to drive shaft 230. For example, according to the illustrated embodiment, wash pump impeller 250 is positioned proximate inlet 208 of diffusing plenum 206. In addition drain pump impeller 252 is positioned within a drain basin 254 at a bottom of sump 138. In this manner, motor 224 is operable to rotate drive shaft 230 in a first direction during a wash cycle (e.g., for urging a flow of wash fluid through diffusing plenum 206) and in an opposite second direction during a drain cycle (e.g., for discharging wash fluid out of drain basin 254 through a discharge conduit 256).

Pump assembly 200 may further include a diverter assembly 260 for selectively directing wash fluid within fluid distribution system 150. More specifically, referring for example to FIGS. 4, 5, and 8, during the wash cycle, pump assembly 200 draws wash fluid in from sump 138 and pumps it to diverter assembly 260. According to the illustrated embodiment, diverter assembly 260 may include a diverter disk 262 disposed within a diverter chamber 264 for selectively distributing the wash fluid to various spray assemblies 134, 140, 142, 144 and/or other spray manifolds or devices. For example, diverter disk 262 may have a plurality of apertures 266 that are configured to align with one or more outlet ports 268 at the top of diverter chamber 264, e.g., as defined by a diverter cap 270. In this manner, diverter disk 262 may be selectively rotated to provide wash fluid to the desired spray device.

As illustrated, diverter chamber 264 is positioned above diffusing plenum 206 along the vertical direction V and is defined at least in part by outer diffuser shell 204 and diverter cap 270 is positioned on top of outer diffuser shell 204. However, it should be appreciated that diverter assembly 260 could instead be an entirely separate device that is attached to or otherwise fluidly coupled with diffusing plenum 206. In addition, diverter assembly 260 is illustrated as using a hydraulically actuated rotation mechanism to position diverter disk 262 to provide the desired fluid flow between spray assemblies without the need for a motor. However, according to alternative embodiments, diverter disk 262 could instead be motor driven or may be positioned using any suitable device or apparatus for rotating diverter disk 262 about the axial direction A.

Figure 6:
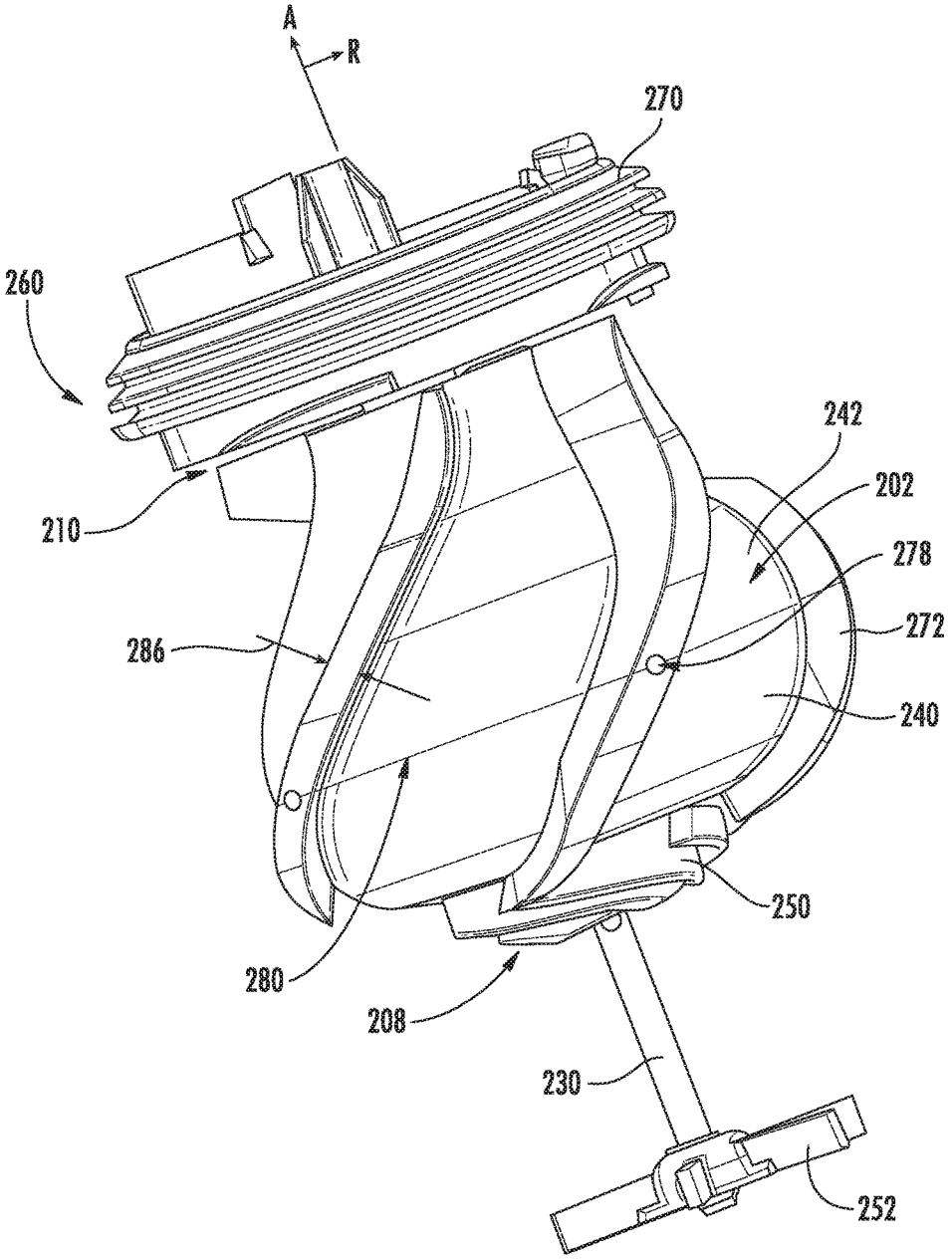
FIG. 6 provides a front view of the exemplary pump assembly of FIG. 3 with an outer diffuser shell removed for clarity.
Figure 7:
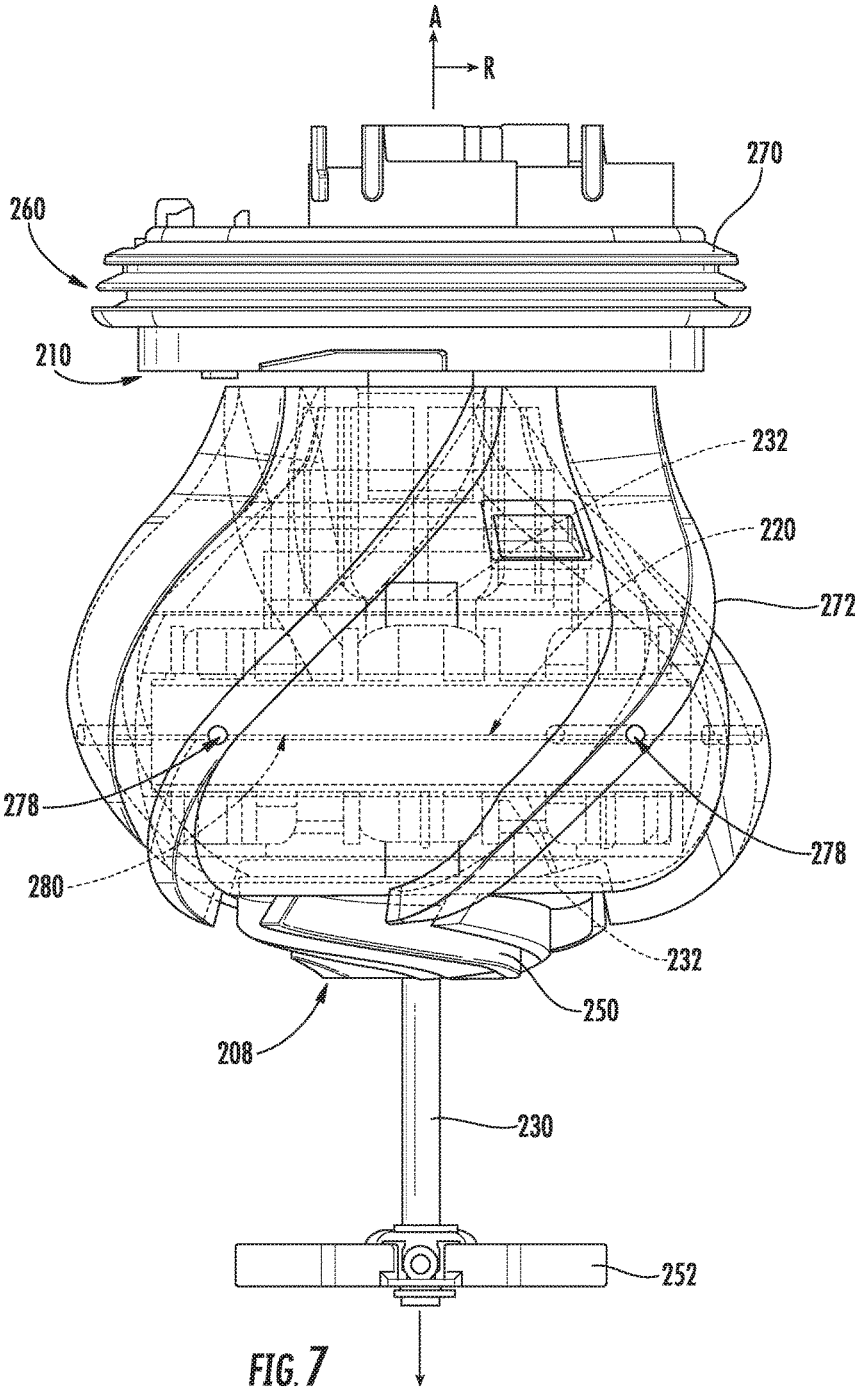
FIG. 7 provides a front view of the exemplary pump assembly of FIG. 3 with the outer diffuser shell removed for clarity and an inner diffuser shell illustrated in phantom.
Figure 8:
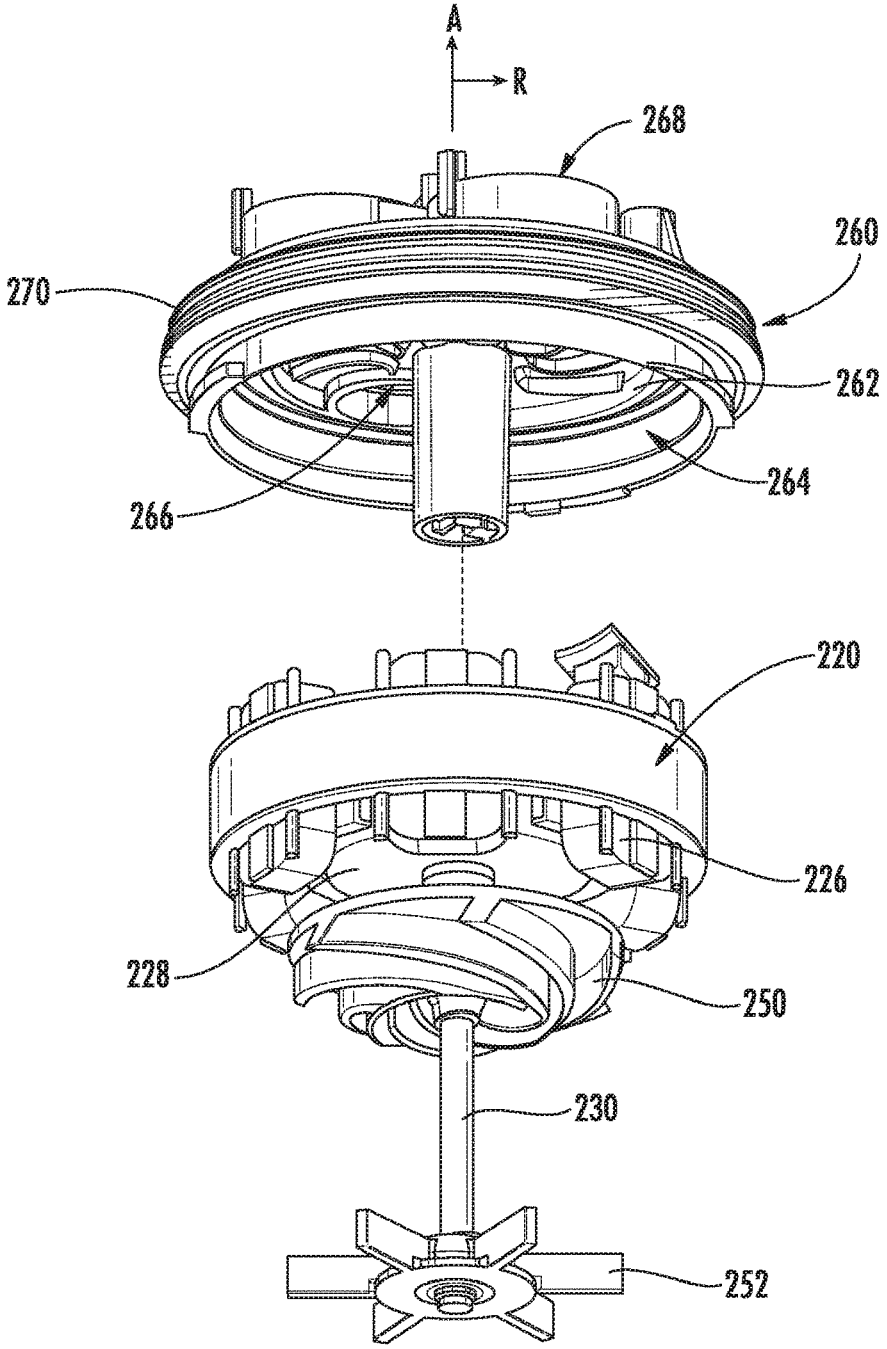
FIG. 8 provides an exploded view of certain components of the exemplary pump assembly of FIG. 3.

Referring now to FIGS. 5 through 7, pump assembly 200 further includes a plurality of guide vanes 272 extending between inner diffuser shell 202 and outer diffuser shell 204 within diffusing plenum 206. In general, guide vanes 272 are configured for receiving, diffusing, and directing the flow of wash fluid from wash pump impeller 250. The flow of wash fluid is thus directed through outlet 210 into diverter chamber 264 in the desired direction and having the desired flow properties for a given application.

According to the illustrated embodiment, pump assembly 200 includes five guide vanes 272 spaced equidistantly about the circumferential direction C. In addition, guide vanes 272 are helical and wrap around inner diffuser shell 202. Guide vanes 272 are also continuous and extend between inlet 208 and outlet 210 of diffusing plenum 206. However, it should be appreciated that according to alternative embodiments, any suitable number, size, position, and configuration of guide vanes 272 may be used to direct the flow of wash fluid as desired.

Notably, pump assembly 200 is positioned within sump 138 and is frequently submerged in water. As a result, pump assembly 200 includes several design features for ensuring the proper and safe operation of motor 224. For example, one or more electrical wires 276 are used for providing electrical power to motor 224. For both fluid flow dynamics and electrical safety reasons, it is desirable to avoid the presence of electrical wires 276 within diffusing plenum 206. Thus, pump assembly 200 generally defines one or more holes 278 through which electrical wires 276 may pass to avoid contact with the wash fluid within diffusing plenum 206, as described below.

Figure 9:
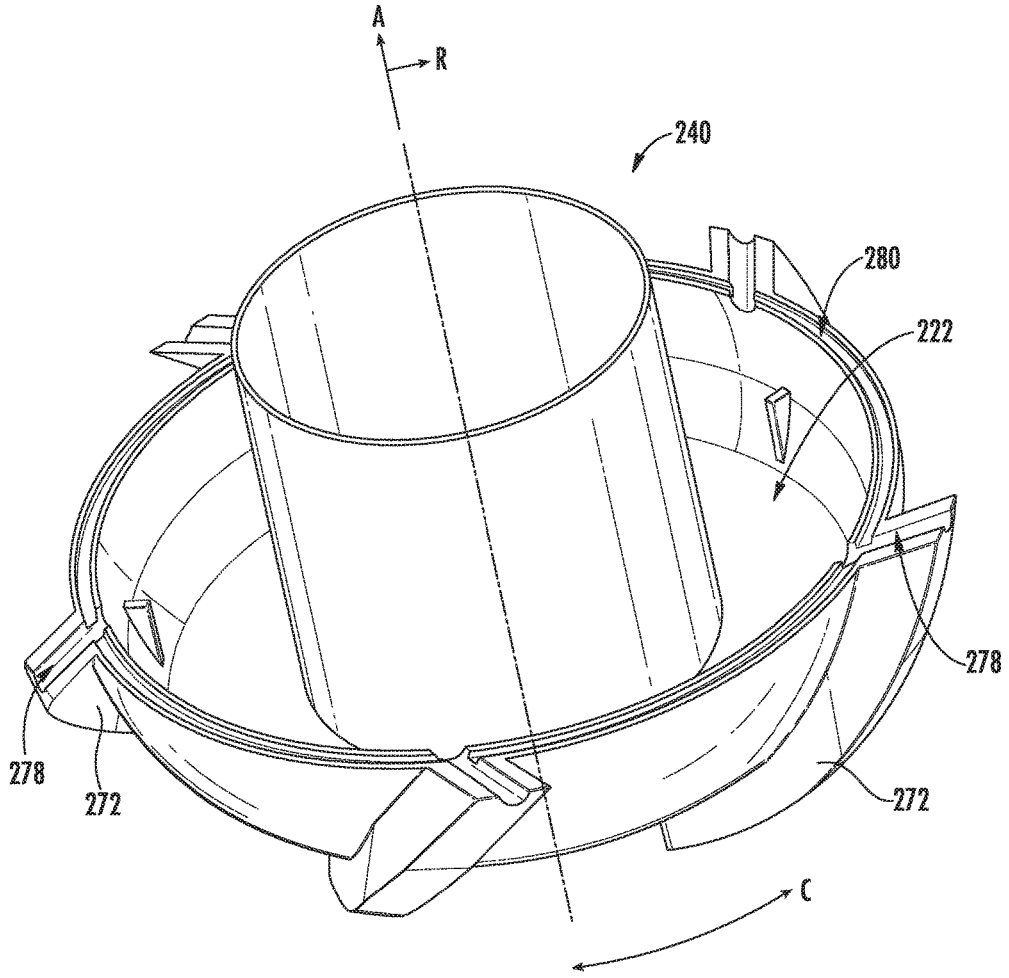
FIG. 9 provides a perspective view of a bottom portion of the inner diffuser shell of the exemplary pump assembly of FIG. 3.

More specifically, for example, holes 278 are defined through outer diffuser shell 204, through at least one of the plurality of guide vanes 272, and through inner diffuser shell 202 into motor housing 222. As best illustrated in FIGS. 9 and 10, according to one exemplary embodiment, lower inner portion 240 and upper inner portion 242 are joined by a slot and groove joint 280. Similarly, lower outer portion 244 and upper outer portion 246 are joined by a flange 282. Both flange 282 and slot and groove joint 280 may define a portion of holes 278.

According to the illustrated embodiment, guide vanes 272 have a constant thickness 286 and holes 278 are defined through the middle of guide vanes 272. However, according to alternative embodiments, guide vanes 272 may vary in thickness 286 to accommodate one or more electrical wires 276. In addition, as best shown in FIGS. 7 and 9, holes 278 extend in a single plane defined perpendicular to the axial direction A. However, it should be appreciated that according to alternative embodiments, holes 278 can extend through guide vanes 272 at any suitable angle or orientation.

Any suitable number of electrical wires 276 may be passed into motor housing 222 through any suitable number of holes 278. For example, according to the illustrated embodiment, motor 224 requires three electrical wires 276 that are illustrated as a single bundle passing through a single hole 278. However, according to alternative embodiments, each of a plurality of electrical wires 276 may pass through any suitable number of holes. Moreover, as best illustrated in FIG. 5, pump assembly 200 includes a plurality of support arms 290 extending from a bottom of outer diffuser shell 204. Each of support arms 290 defines a central passage 292 through which electrical wires 276 may pass out of sump 138 of dishwasher appliance 100. Thus according to an exemplary embodiment, electrical wires 276 make no contact with water within sump 138 and do not require any special coatings, safety switches, etc.

To ensure motor 224 and wires 276 are securely and safely mounted within pump assembly 200, exemplary embodiments of the present subject matter use a potting material or encapsulation material to secure these components, e.g., to provide electrical isolation and to prevent water intrusion or exposure. For example, motor housing 222 and/or holes 278 can be filled with a potting material to encapsulate motor 224, electrical wires 276, or other components. In addition, or alternatively, electrical wires 276 may be overmolded into holes 278. Other means of water proofing and securing various components of pump assembly 200 are possible and within the scope of the present subject matter.

According to exemplary embodiments, inner diffuser shell 202 and guide vanes 272 may be formed in any suitable manner and may have any suitable sizes or geometries. For example according to one exemplary embodiment, inner diffuser shell 202 and guide vanes 272 are integrally formed as a single integral piece, e.g., via injection molding. In addition, inner diffuser shell 202 may have thin walls or may be formed from a thermally conductive material in order to improve the thermal communication between motor 224 and the flow of wash fluid within diffusing plenum 206. In this manner, motor 224 may be cooled while wash fluid is simultaneously heated, thereby ensuring safe motor 224 operation and reducing the amount of additional heating required to raise the temperature of the wash fluid to the desired temperature. Other configurations and constructions are possible and within the scope of the present subject matter.

It should be appreciated that pump assembly 200 is described herein only for the purpose of explaining aspects of the present subject matter. Modifications and variations may be made to pump assembly 200 while remaining within the scope of the present subject matter. For example, the size, geometry, and relative positioning of inner diffuser shell 202 and outer diffuser shell 204 may vary and the position and configuration of motor assembly 220 may adjusted while remaining within the scope of the present subject matter. Pump assembly 200 as described above provides a simple, compact, and effective system for urging a flow of wash fluid within fluid circulation assembly 150 or any other pump system within dishwasher appliance 100. Other configurations and benefits will be apparent to those of skill in the art.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A pump assembly for a dishwashing appliance, the pump assembly defining an axial direction, a radial direction, and a circumferential direction, the pump assembly comprising:

an inner diffuser shell defining a motor housing;

an outer diffuser shell spaced apart from the inner diffuser shell to define a diffusing plenum;

a plurality of guide vanes fixed relative to the inner diffuser shell and extending between the inner diffuser shell and the outer diffuser shell within the diffusing plenum; and a motor positioned within the motor housing and comprising a drive shaft for rotating a wash pump impeller and urging a flow of wash fluid through the diffusing plenum.

2. The pump assembly of claim 1, further comprising a diverter defining a diverter chamber, the diffusing plenum being in fluid communication with the diverter chamber.

3. The pump assembly of claim 2, wherein the diverter chamber is defined at least in part by the outer diffuser shell.

4. The pump assembly of claim 2, wherein the diverter chamber is positioned above the diffusing plenum along the vertical direction.

5. The pump assembly of claim 1, wherein the motor housing is filled with a potting material to encapsulate the motor such that no fluid flows through the inner diffuser shell.

6. The pump assembly of claim 1, wherein the motor is in thermal communication with the flow of wash fluid within the diffusing plenum.

7. The pump assembly of claim 1, wherein the plurality of guide vanes comprises five guide vanes spaced equidistantly about the circumferential direction.

8. The pump assembly of claim 1, wherein the plurality of guide vanes are helical and wrap around the inner diffuser shell.

9. The pump assembly of claim 1, wherein the plurality of guide vanes are continuous and extend between an inlet of the diffusing plenum and an outlet of the diffusing plenum.

10. The pump assembly of claim 1, wherein the inner diffuser shell and the plurality of guide vanes are injection molded as a single integral piece.

11. The pump assembly of claim 1, further comprising a drain pump impeller mounted to the drive shaft, wherein the motor is operable to rotate the drive shaft in a first direction during a wash cycle and in a second direction during a drain cycle, the second direction being opposite the first direction.

12. The pump assembly of claim 11, wherein the wash pump impeller is positioned above the drain pump impeller along the vertical direction.

13. The pump assembly of claim 1, wherein the motor is vertically oriented within a sump of a dishwasher appliance, such that the drive shaft extends parallel to a vertical direction defined by the dishwasher appliance.

14. The pump assembly of claim 13, wherein the pump impeller is positioned near a bottom of the sump of the dishwasher appliance and an inlet of the diffusing plenum faces down toward the bottom of the sump.

15. The pump assembly of claim 1, wherein the motor comprises a stator positioned entirely within the inner diffuser shell.

16. A dishwasher appliance defining a vertical direction, the dishwasher appliance comprising:

a wash tub that defines a wash chamber;

a sump for collecting wash fluid;

a pump assembly positioned within the sump, the pump assembly defining an axial direction, a radial direction, and a circumferential direction, the pump assembly comprising:

an inner diffuser shell defining a motor housing;

an outer diffuser shell spaced apart from the inner diffuser shell to define a diffusing plenum;

a plurality of guide vanes fixed relative to the inner diffuser shell and extending between the inner diffuser shell and the outer diffuser shell within the diffusing plenum; and a motor positioned within the motor housing and comprising a drive shaft for rotating a wash pump impeller and urging a flow of wash fluid through the diffusing plenum.

17. The dishwasher appliance of claim 16, further comprising a diverter positioned above the diffusing plenum along the vertical direction, the diverter defining a diverter chamber in fluid communication with the diffusing plenum.

18. The dishwasher appliance of claim 16, wherein the plurality of guide vanes are helical and wrap around the inner diffuser shell, and wherein the plurality of guide vanes are continuous and extend between an inlet of the diffusing plenum and an outlet of the diffusing plenum.

19. The dishwasher appliance of claim 16, wherein the motor is vertically oriented within the sump of the dishwasher appliance, such that the drive shaft extends parallel to a vertical direction defined by the dishwasher appliance, and wherein the pump impeller is positioned near a bottom of the sump of the dishwasher appliance and an inlet of the diffusing plenum faces down toward the bottom of the sump.

20. The dishwasher appliance of claim 16, wherein the motor comprises a stator positioned entirely within the inner diffuser shell.

* * * * *